US008088276B2

(12) United States Patent
Marden

(10) Patent No.: US 8,088,276 B2
(45) Date of Patent: Jan. 3, 2012

(54) OIL RE-REFINING SYSTEM AND METHOD

(75) Inventor: Antony Louis Marden, Hong Kong (HK)

(73) Assignee: CleanOil Limited, Yuen Long (HK)

( * ) Notice: Subject to any disclaimer, the term of this patent is extended or adjusted under 35 U.S.C. 154(b) by 542 days.

(21) Appl. No.: 12/188,386

(22) Filed: Aug. 8, 2008

(65) Prior Publication Data

US 2010/0032342 A1 Feb. 11, 2010

(51) Int. Cl.
*C10M 175/02* (2006.01)

(52) U.S. Cl. ..... 208/180

(58) Field of Classification Search ..... 208/177, 208/179–186, 290

See application file for complete search history.

(56) References Cited

U.S. PATENT DOCUMENTS

| | | | | |
|---|---|---|---|---|
| 1,770,736 | A | 7/1930 | Funk | |
| 2,917,448 | A | 12/1959 | Beuther et al. | |
| 3,016,350 | A * | 1/1962 | Butler et al. | 208/264 |
| 3,369,999 | A * | 2/1968 | Donaldson et al. | 208/264 |
| 3,919,076 | A | 11/1975 | Cutler et al. | |
| 4,073,720 | A | 2/1978 | Whisman et al. | |
| 4,211,633 | A | 7/1980 | Gleim | |
| 4,233,140 | A | 11/1980 | Antonelli et al. | |
| 4,277,445 | A * | 7/1981 | De Schepper et al. | 210/195.1 |
| 4,406,778 | A * | 9/1983 | Borza et al. | 208/179 |
| 4,465,590 | A | 8/1984 | Adams | |
| 4,797,198 | A | 1/1989 | Wetzel et al. | |
| 5,112,479 | A * | 5/1992 | Srimongkolkul | 210/149 |
| 5,132,399 | A | 7/1992 | MacDonald et al. | |
| 5,935,417 | A | 8/1999 | Cody et al. | |
| 6,048,447 | A | 4/2000 | Hayner et al. | |
| 6,174,431 | B1 | 1/2001 | Williams et al. | |
| 6,875,351 | B2 | 4/2005 | Arnaud | |
| 7,226,533 | B2 | 6/2007 | Aramburu | |

FOREIGN PATENT DOCUMENTS

| | | |
|---|---|---|
| CN | 1107109 C | 4/2003 |
| CN | 100334189 C | 8/2007 |
| EP | 0757091 | 2/1997 |
| FR | 1516733 | 2/1968 |
| FR | 2061614 | 6/1971 |
| FR | 2301592 | 9/1976 |

* cited by examiner

*Primary Examiner* — Jill Warden
*Assistant Examiner* — Randy Boyer
(74) *Attorney, Agent, or Firm* — Leason Ellis LLP

(57) ABSTRACT

A lubricating oil re-refining system and process provide a highly efficient and environmentally sound alternative for reclaiming and reusing spent oils. The re-refining process advantageously removes the additives, water, wear metals and other contaminants from the used lubricating oil, while at the same time, returns the base oil fraction that once again can be blended with additives and can be restored to its original high quality specifications for reuse without causing secondary pollution.

17 Claims, 1 Drawing Sheet

OIL RE-REFINING SYSTEM AND METHOD

TECHNICAL FIELD

Figure 1:
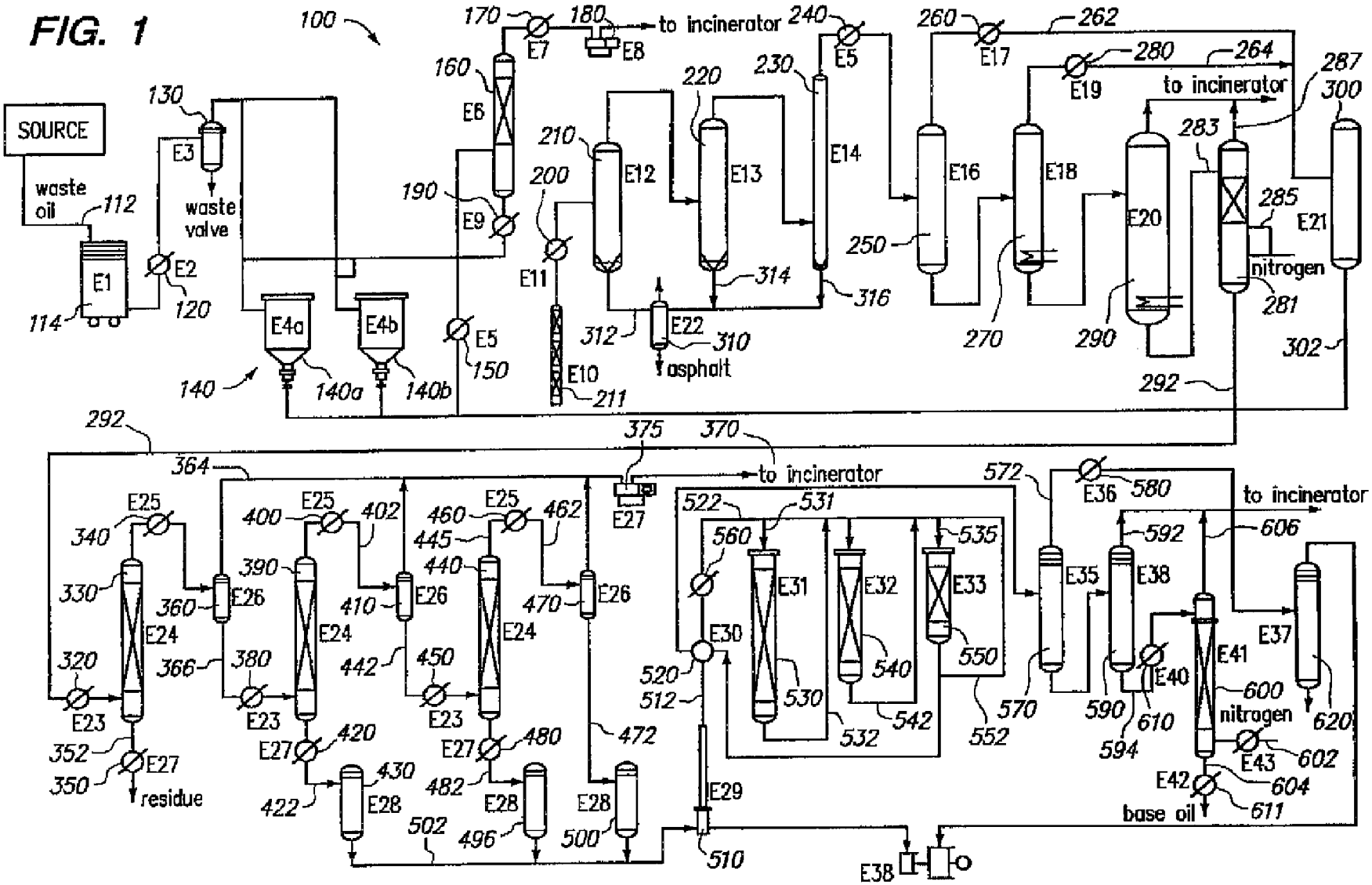

The present invention relates in general to the petroleum industry and in particular, relates to the use of a multi-stage process that incorporates a number of components, including cyclone separators and multi reactors, to reclaim useful oil fractions from used oil.

BACKGROUND

The sharp increase in demand in lubricating oils and the limited petroleum reserves throughout the world have caused a sharp increase in the price of petroleum products and have led to great concern that the limited supplies will not meet future demand given the sharp increase in the demand from developing and developed countries. In recent years, large developing nations have become more industrialized and this has resulted in the demand for petroleum products in these countries rising significantly. In addition, each year large amounts (e.g., 150 million barrels or more) of used lubricating oils, such as automotive oils, gear oils, turbine oils, and hydraulic oils which through usage or handling are unfit for their intended use, are generated world-wide. Used oil that is derived from 150 million cars or more and other machines accumulates in thousands of service stations, repair shops and industrial plants.

Lubricating oil does not wear out during use but over time it does become contaminated with heavy metals, water, fuel, carbon particles and degraded additives. Eventually, the lubricating oil becomes so contaminated that it cannot satisfactorily perform its lubricating function and therefore must be replaced. Public opinion and government intervention and new legislation are increasingly demanding the material recycling, rather than the burning or dumping, of waste products. Used lubricating oil can contain 60 to 97% highly valuable materials (which is generally in the form of mineral oil and synthetic oil fraction) which is worth significantly more than heavy fuel oil. It is therefore desirable to extract and reuse the valuable materials.

Besides being illegally dumped, used lubricating oils can be treated in a number of different ways including but not limited to: (1) burning the lubricating oils as fuel after stripping sludge and water therefrom; (2) direct burning of the lubricating oil; and (3) re-refining the spent lubricant oils into base stocks. When used oil is either burned directly or as fuel after stripping treatment, the contaminants in oil are emitted as atmospheric pollutants. This also results in wasting base oils which otherwise could be recovered and reused.

Accordingly, re-refining is needed to collect lubricating oil and to re-refine used oil into quality material to reduce consumption of virgin base oils and, thereby conserving energy and natural resources. Unfortunately, to date, refiners of crude oil have not aggressively implemented and undertaken the recovery of base oils. This is because, in part, although used oil represents a sizable raw material source for re-refining, its volume is relatively small compared to the world's crude oil market. In addition, used oil is contaminated with added substances and impurities which can cause expensive disruption and downtime in conventional refining facilities.

It has been known since the early 1900s that used lubricating oil from engines and machinery can be recycled. However, despite a number of different re-refining techniques being implemented over the years to extract base oils from lubricants, most of these techniques (1) have low product yields; (2) do not solve potential pollution; (3) produce base oils with poorer quality than virgin base oils; and (4) are costly to implement.

SUMMARY

According to this invention, a lubricating oil re-refining system and process provide a highly efficient and environmentally sound alternative for reclaiming and reusing used oils. The re-refining process advantageously removes the additives, water, wear metals and other contaminants from the used lubricating oil, while at the same time, returns the base oil fraction that once again can be reformed to higher quality to its original quality specifications and can be blended with additives to produce lubricating oil with specific function and characteristic.

According to one embodiment, a method of re-refining used oil includes the steps of: (1) filtering the used oil through a multi-layer filter; (2) processing the used oil in a cyclone separator to reduce the water content of used oil after the oil has been filtered; (3) processing the used oil in a flash tower to evaporate all of the water and light organic fraction from used oil after a large amount of water has been removed by the cyclone separator; (4) introducing liquefied propane into the used oil to form an oil/propane mixture; (5) processing the used oil in a multi-stage extraction process that includes a plurality of extraction towers linked in series, wherein each tower has an inverted cone shape to promote enhanced removal of undesired components that settle in the tower and are discharged to a storage container; and (6) transferring the oil/propane mixture from the extraction tower in the series to a propane recovery process where propane is recovered from the mixture and the used oil is ready for further processing.

The method can also include the steps of: (7) distilling the oil in a distillation apparatus after the propane extraction process; (8) withdrawing at least a portion of at least one distillated fraction from the distillation apparatus; (9) delivering at least a portion of the at least one withdrawn distillated fraction to at least one other distillation apparatus arranged in series for withdrawing at least a portion of at least one distillate fraction from the at least other distillation apparatus; and (10) delivering at least a portion of the at least one withdrawn distillated fraction to a hydro-fining process.

The hydro-fining process includes the steps of: (1) mixing hydrogen with the oil after the oil is discharged from the last distillation apparatus in the series; (2) introducing the hydrogen and oil mixture into at least one hydro-fining reactor that is packed and allows hydrogenation of selected compounds in the oil to occur; (3) introducing the hydro-treated oil into a high pressure separator that is configured to separate one or more gases from the hydro-treated oil in a high pressure environment; and (4) introducing the oil that has been discharged from the high pressure separator into a low pressure separator that is configured to separate one or more gases (mainly hydrogen) from the oil in low pressure environment.

BRIEF DESCRIPTION OF DRAWING FIGURE

FIG. 1 is a schematic representation of a re-refining plant for performing a re-refining process in accordance with one embodiment of the present invention.

DETAILED DESCRIPTION OF EMBODIMENTS

FIG. 1 depicts a plant or system 100 for performing a re-refining process in accordance with one embodiment of the present invention for removing additives, water, wear metals and other contaminants from used oil and returning the base oil fraction that can be reused. The plant 100 includes a number of different components or pieces of equipment that are arranged to define different stages of the re-refining process. As described below, the combination and arrangement of the equipment yields improved re-refining performance results compared with conventional processes, as well as, being an environmentally sound alternative to other processes.

The system (plant) 100 includes a source 110 of used oil. The source 110 can be in any number of different forms including a large intake and holding container that has a conduit (pipe) 112 and pumping mechanism for transferring the used oil from the container to another location to begin the treatment process. FIG. 1 shows conduit 112 being in fluid communication with a strainer 114 that serves to filter the used oil that is delivered thereto from the source 110. The strainer 114 is constructed to filter even the smallest solid particles from the used oil. For example, the strainer 114 can be configured to include multiple filter layers (metal sieves) and in one embodiment, the strainer 114 is constructed to include four layers that have different filtering characteristics. For example, the strainer 114 can include four layers of filter made up of 60, 80, 100 and 120 mesh filter medium. This results in a progressive filtering of the used oil resulting in foreign particles and other waste material being filtered from the used oil. It will be appreciated that other sized filter medium can be used.

After being filtered by the strainer 114, the used oil is then delivered to a heater 120 that operates at a temperature that results in a reduction in the density of the oil. For example, the heater 120 can be programmed to operate at a temperature that results in the oil being heated to a temperature between about 50° C. and about 60° C. The heated oil is then delivered to a separator 130. A separator for use in petroleum production is a device that is typically designed to separate processing fluids into their constituent components. This type of device works on the principle that the two components have different densities, which allows them to stratify on gravity, with oil on the top, while water is on the bottom. Any solids present in the used oil will also settle in the bottom of the separator. The separator 130 can be any number of conventional separators that are configured to separate water from oil and in one embodiment, the separator 130 is a cyclone separator. As is known, a cyclone separator uses centrifugal force to separate one component from another component. The operation of the cyclone separator 130 results in separating oil from a large amount of water. The separated water can be removed at this point.

After the cyclone separation process, the used oil (waste oil) is then delivered to one or more settlers 140 that serve to store the waste oil after the cyclone separation process. In FIG. 1, there are two settlers 140*a*, 140*b* shown that are each in fluid communication with the separator 130 for receiving oil therefrom. Depending upon the specific storage demands, one or more settlers 140*a*, 140*b* can be used.

After being stored in the settlers 140*a*, 140*b*, the used oil is then delivered to a heater 150 which operates at a temperature that elevates the temperature of the used oil to make the water and light fraction in oil vaporize. The heater 150 operates to heat the used oil to a temperature of about 200° C. to about 220° C.

After being preheated to about 200° C. to about 220° C. by the heater 150, the oil is delivered to a device 160, such as a flash tower, that promotes water and light component in the oil to vaporaize. The flash tower 160 operates at a temperature of about 200° C. to about 220° C. and at a vacuum of about −101.1 kPa. The flash tower operates at such temperature and pressure since these parameters are about equivalent to operating the flash tower at atmospheric pressure at a temperature of about 150° C. This results in further separation and refinement of the used oil. The vapors of water and light component are then delivered to a condenser 170 which condenses the vapors of the water and the light component. A vacuum pump 180 operates to build up a vacuum inside the flash tower 160. A cooler 190 operates to cool down the oil that is coming from the flash tower 160.

A mixer 211 is provided and receives the cooled used oil and mixes it with liquefied propane. In one example, the mixer 211 operates at the following parameters: at a temperature of about 20° C. to about 40° C. and a pressure between about 4.0 MPa to about 4.4 MPa. The ratio of propane to oil is about 6:1 to about 8:1 by volume. It will be appreciated that other operating parameters are equally possible depending upon other considerations. In this case where mixer 211 is a propane/oil mixing tower, the oil is pumped into the bottom of the tower by a feeding pump and at the same time, the propane is pumped into the bottom of the tower by a feeding pump (the propane can be reused as described below). Once propane and oil are fed to the bottom of the tower, both propane and oil flow through the tower and mix up well since the tower is packed with inert material to increase the mixing efficiency of the two materials.

After the used oil is mixed with liquefied propane, the mixture is transferred to a heater 200 from the top of the mixer 211. The heater 200 operates to heat the mixture to a temperature of between about 80° C. to about 90° C.

The heated oil is then delivered to a multi-stage extraction process. For example, the multi-stage extraction process includes a number of different devices that are configured and arranged to remove heavy substances from the heated oil. For example, a plurality of extraction towers can be arranged in series to extract certain components from oil. In FIG. 1, the first extraction tower 210 performs primary sedimentation of asphalt, resin, additives, and metal compounds from the oil. The first extraction tower 210 operates at a temperature of between about 80° C. to about 90° C. and at a pressure of about 4.0 MPa to about 4.4 MPa. As the temperature increases, the solubility of the propane drops and undesired fractions in the mixture further settle in the bottom of the device. The retention time of the heated oil in the first extraction tower 210 is on the order of about 30 minutes. The treated oil is delivered from the first extraction tower 210 to a second extraction tower 220 that performs secondary sedimentation of asphalt, resin, additives, and metal compounds from the oil. The second extraction tower 220 operates at a temperature of between about 80° C. to about 90° C. and at a pressure of about 4.0 MPa to about 4.4 MPa. The retention time of the heated oil in the second extraction tower 220 is on the order of about 20 minutes. The treated oil is delivered from the second extraction tower 220 to a third extraction tower 230 that performs additional tertiary sedimentation of asphalt, resin, additives, and metal compounds from the oil. The third extraction tower 230 operates at a temperature of between about 80° C. to about 90° C. and at a pressure of about 4.0 MPa to about 4.4 MPa. The retention time of the heated oil in the third extraction tower 230 is on the order of about 20 minutes.

In one embodiment, the multi-stage extraction process uses towers 210, 220, 230 that have inverted cone-shaped outlines to ensure the complete removal of resin and asphalt from the bottom.

The oil is then delivered from the third extraction tower 230 to a heater 240 that heats the oil to a predetermined temperature. In one embodiment, the oil is heated to a temperature between about 97° C. to about 102° C. After being heated by heater 240, the oil is delivered to a recovery stage for recovering the propane from the mixture. As with the extraction process, the propane recovery stage can be defined by a plurality of recovery devices and in particular, a series of recovery towers. In the illustrated embodiment, a first recovery tower 250 provides a primary means for recovering propane from the mixture. The first recovery tower 250 operates at a temperature of about 97° C. to about 102° C. and at a pressure of about 4.0 MPa to 4.4 MPa. A first condenser 260 is operatively connected to the first recovery tower 250 for receiving propane gas from the first recovery tower 250. The condenser 260 condenses the propane gas into liquid. The mixture is delivered from the first recovery tower 250 to a second recovery tower 270 that operates to further recover propane from the mixture. In other words, the second recovery tower 270 acts as a secondary propane recovery from the mixture. The second recovery tower 270 can operate at a temperature of about 130° C. to about 170° C. and at pressure of about 0.8 MPa to about 1.3 MPa.

As with the first recovery tower 250, the second recovery tower 270 is operatively connected to a second condenser 280 for receiving propane gas from the second recovery tower 270. The condenser 280 condenses additional propane gas that is present into a liquid. Propane extraction facilitates removal of additive polymers and oxidative condensed compounds which greatly decreases the acidity and metal contents of the used oil.

After passing through the second recovery tower 270, the mixture is delivered to a storage vessel 290. The storage vessel 290 stores the used oil after the propane treatment. The first condenser 260 is connected via a conduit 262 to a propane recycle vessel 300 and the second condenser 280 is connected via a conduit 264 to the vessel 300. The propane that is recovered within the first and second condensers 260, 280 is thus routed to and collected in the vessel 300. The vessel 300 is connected via a conduit 302 to the mixer 211 so that the propane that is recovered from the condensers 260, 280 and stored at the vessel 300 can be delivered back to the mixer 211 where it is mixed with the oil as discussed previously.

In addition, the plant 100 includes an asphalt recovery means and in particular, an asphalt collecting container 310 is provided for receiving asphalt (sediment from the extraction process). In particular, a first asphalt conduit 312 connects the first extraction tower 210 to the container 310, a second asphalt conduit 314 connects the second extraction tower 220 to the container 310, and a third asphalt conduit 316 connects the third extraction tower 230 to the container 310. This allows asphalt that is collected at the first, second and third extraction towers 210, 220, 230 to be collected. The asphalt can then be removed from the container 310 and reused or reprocessed at another location. In other words, the asphalt is a recycled material.

The storage vessel 290 can be operatively connected to a separator 281, in the form of a gas stripping tower. In a gas stripping process, certain constituents can be removed from a stream (such as a hydrocarbon stream, in this case, a lube oil stream) by stripping the hydrocarbon stream with a gas stream. In particular, the heated feed stream (in this case heated lube oil) is fed to the stripping tower 281. The preheated stream is introduced through conduit 283 at or near the top of the stripping tower 281. Stripping gas is introduced through conduit 285 at or near the bottom of the tower 281. The stripping gas can be nitrogen or hydrogen or another suitable gas and is fed at a relatively high rate sufficient to provide a partial pressure that produces a stripped hydrocarbon (lube oil) stream that is removed through conduit 292 at or near the bottom of the tower 281 after flowing downward through the tower internals. The stripping gas bubbles up through the liquid hydrocarbon in the tower 281 becoming enriched in the constituents (e.g., propane and water) that are to be removed from the tower 281 and exits the top of the tower as a rich gas stream. The enriched gas stream can exit through a conduit 287 at or near the top of the tower 281. The conduit 287 is fluidly connected to a conduit and the enriched gas stream can be delivered to another location, such as an incinerator.

The stripped hydrocarbon (lube oil) stream travels through the conduit 292 to a heater 320 that heats the oil from the gas stripping tower 281 to a predetermined temperature. In one embodiment, the oil is heated to a temperature of between about 297° C. to about 300° C. After being heated to the predetermined temperature, the oil is delivered to a first vacuum distillation tower 330. The first vacuum distillation tower 330 distills the oil to have different fractions of base oil, e.g., light, medium and heavy oil fractions. In one embodiment, the first vacuum distillation tower 330 operates at a temperature of about 297° C. to about 300° C. and at a pressure of about 0.5 mmHg. The first tower 330 is operatively connected to a condenser 340 via a conduit 342. The condenser 340 is configured to cool and condense the distilled base oil. The first tower 330 is also connected to a cooler 350 via a conduit 352. The cooler 350 operates to cool down base oil from the vacuum distillation tower 330 and the material that is cooled down by the cooler 350 can then be delivered as residue to another location.

The condenser 340 is connected to a storage vessel 360 via a conduit 362. The storage vessel 360 collects the base oil from the tower 330. A portion of the base oil is delivered from the vessel 360 via a conduit 364 to another device and/or location. For example, a preselected portion of the oil can be delivered via conduit 364 to an incinerator 370. Another portion of the base oil is transferred via a conduit 366 to a heater 380 that serves to heat the oil from the vessel 360. In one embodiment, the oil is heated to a temperature of between about 275° C. This heated oil after passing through the heater 380 is then delivered to another (second) vacuum distillation tower 390 where the base oil is further distilled. In particular, the second vacuum distillation tower 390 is configured to vaporize the light and medium oil (different oil fraction) and the heavy oil stays at the bottom of the tower 390. One by-product of the second vacuum distillation tower 390 is vaporized lube oil and the vacuum distillation tower 390 is therefore operatively connected to a condenser 400 that re-condenses the lube oil. After being re-condensed in the condenser 400, the lube oil travels via a conduit 402 to a storage vessel 410 that stores the condensed lube oil.

The second vacuum distillation tower 390 is also connected to another cooler 420 that cools down the temperature of the lube oil prior to the lube oil being delivered via a conduit 422 to a storage vessel 430.

In the illustrated embodiment, the vacuum distillation tower is actually defined by a series of towers including the towers 330, 390. In addition, there is optionally a third vacuum distillation tower 440. The third tower 440 is connected to the storage vessel 410 by means of a conduit 442 and along the conduit 442, the lube oil from the storage vessel 410 is once again heated by a heater 150 to a temperature of about 250° C. prior to deliver to the third tower 440. At the third tower 440, the light lube oil is again vaporized into light and medium oil and the vaporized lube oil is discharged from the third tower 440 via a conduit 445 to a condenser 460 where the vaporized lube oil is recondensed prior to delivery via conduit 462 to a storage vessel 470 where the recondensed oil is collected.

It will also be appreciated that each of the storage vessels 360, 410, 470 is fluidly connected to the conduit 364 to allow the non-condensed gas to be delivered to the incinerator 370. Before reaching the incinerator, the non-condensed gas that travels within the conduit 364 is introduced into a vacuum pump in order to form a vacuum pressure.

As with the towers 330, 390, the third tower 440 is also connected to a cooler 480 that cools down the temperature of the lube oil from the third tower 440. After being cooled down by cooler 480, the lube oil passes through a conduit 482 to a storage vessel 496.

The oil that is contained within the storage vessel 470 is delivered via a conduit 472 to another storage vessel 500. As shown in FIG. 1, each of the storage vessels 430, 496, 500 that collects and stores the lube oil after the vacuum distillation process is connected to a common conduit 502. In other words, the stored lube oil is discharged from each of the storage vessels 430, 496, 500 into the common conduit 502 for delivery to another component/location.

For example, the conduit 502 can be operatively connected to another processing stage of the plant 100. In the illustrated embodiment, the conduit 502 delivers the lube oil that is collected from the vacuum distillation process to a hydro-fining (hydrogenation) processing stage. In addition to the other processes described hereinbefore, hydro-fining is employed to further polish the re-refined oil. In hydro-fining, the sulphur-, nitrogen-, chlorine-based compounds, oxidative compounds and olefins are converted to their corresponding saturated carbons by hydrogen.

Accordingly, the conduit 502 is connected to a mixer 510 (e.g., static mixer) that mixes the lube oil (base oil) with hydrogen. In one embodiment, the mixing occurs at a temperature of between about 20° C. and about 40° C. and at a pressure of between about 4.0 MPa and about 4.2 MPa. The ratio of hydrogen to base oil (hydrogen:oil) is between about 200:1 and about 400:1 by volume.

The mixture that is made up of lube oil and hydrogen is delivered from the mixer 510 via a conduit 512 to a heat exchanger 520 and then goes into a heater 560 to reach the temperature between about 260° C. and about 290° C.

After being heated, the lube oil mixture is delivered via a conduit 522 to one or more reactors that are configured to react with the hydrogen present in the mixed lube oil. For example, there can a series of two or more reactors that each receives the mixed lube oil that includes hydrogen and is packed with reactants that cause specific reactions to occur between compounds and hydrogen. In the illustrated embodiment, there is a series of three reactors; however, it will be understood that the number of reactors that are placed on-line can be selected based on a number of factors, including the specific re-recycling operation that is being undertaken. In the illustrated embodiment, the hydrogen reactor process includes three reactors placed in series. More specifically, the conduit 522 is operatively connected by means of a connector conduit 531 to a first reactor 530 that receives the mixed lube oil. At this point, the lube oil contains a number of different components including different elements. For example, the lube oil contains sulfur, nitrogen, oxygen and chlorine and these elements react with the hydrogen that is mixed in the lube oil. One or more catalysts can be present in the first reactor 530 to increase the reaction velocity and improve the quality of the oil. In one embodiment, the first reactor 530 operates at a temperature of between about 260° C. and about 290° C. and at a pressure of between about 4.0 MPa to about 4.2 MPa. A space velocity of the first reactor 530 can be between about 0.5 $h^{-1}$ and about 1.0 $h^{-1}$.

The first reactor 530 is also connected to a conduit 532 that acts as a discharge conduit and removes the reacted lube oil from the first reactor 530. An opposite end of the conduit 532 is connected to the conduit 522 at a point that is upstream of a second connector conduit 533 that fluidly connects the conduit 522 to a second reactor 540. The second reactor 540 is the same or similar to the first reactor 530 in that it is designed to react the lube oil constituents with the hydrogen. More specifically, the sulfur, nitrogen, oxygen and chlorine in the lube oil are reacted with the mixed hydrogen and catalysts can be present to increase the rate of the reaction. The second reactor 540 is also connected to a discharge conduit 542 that removes the reacted lube oil from the second reactor 540. The discharge conduit 542 is connected to the conduit 522 at a point that is downstream of the connector conduit 533 but upstream of a connector conduit 535 that fluidly connects the conduit 522 to a third reactor 550.

The third reactor 550 is the same or similar to the first and second reactors 530, 540 in that it is designed to react the lube oil constituents with hydrogen. More specifically, the sulfur, nitrogen, oxygen and chlorine in the lube oil is reacted with the mixed hydrogen and catalysts can be present to increase the rate of the reaction. The third reactor 550 is also connected to a discharge conduit 542 that removes the reacted lube oil from the second reactor 540. The discharge conduit 542 is connected to conduit 522 at a point that is downstream of the connector of the conduit 533 but upstream of the connector conduit 535 that fluidly connects the conduit 522 to the third reactor 550.

The three reactors 530, 540, 550 are thus located in series and therefore provide a hydrogen reaction process that runs in series. This allows the lube oil to be successively reacted in order to promote a reaction between the constituents (sulfur, nitrogen, oxygen and chlorine) of the lube oil and the hydrogen that is present in the lube oil mixture. In one embodiment, the first, second and third reactors 530, 540, 550 operate at the same conditions as the reactor 530 in that they operate at a temperature of between about 260° C. and about 290° C. and at a pressure of between about 4.0 MPa to about 4.2 MPa. A space velocity of the reactor 530, 540, 550 can be between about 0.5 $h^{-1}$ and about 1.0 $h^{-1}$.

Hydrogenation or hydro-fining is an effective oil re-refining process that has the ability to treat a wide range of feedstock. Hydro-fining facilitates hydrogenation of sulphur-, nitrogen-based and oxidative compounds; conversion of olefins and aromatics into saturated hydrocarbons; and removal of asphaltenes. Hydro-fining is also able to produce superior quality product base oils with a relatively high yield compared to other oil re-refining processes. The hydro-treated oil can be fractionated into different viscosity fractions and blended with suitable additives to produce lubricating oil meeting the specifications of different industrial uses.

After undergoing a series of reactor steps, the reactor lube oil is discharged through a discharge conduit 562 to a heat exchanger 560 that uses the heat from the reactor lube oil to heat up the feedstock (mixture of oil and hydrogen) that are used in subsequent processes as shown in FIG. 1. In the illustrated embodiment, the heat exchanger 520 is at least used to heat up the feedstock (mixture of oil and hydrogen). The reactor lube oil is injected into a separating process where constituents of the lube oil mixture are separated. More specifically, the reactor lube oil is injected into a high pressure separator 570 that is configured to separate hydrogen from the lube oil in a high pressure environment and in particular, hydrogen gas is removed (recovered) from the lube oil. The separator 570 can operate at a temperature of between about 120° C. and about 150° C. and at a pressure of between 4.0 MPa and about 4.2 MPa.

One by-product of the separator 570 is hydrogen gas which is discharged from the separator 570 through a gas discharge conduit 572 that has a cooler 580 located along its path. The cooler 580 is designed to cool down the hydrogen that is discharged from the separator 570 and prior to it being delivered to another location.

The separator 570 also includes another discharge conduit 574 that is fluidly connected at its opposite end to another separator 590 and in particular, is connected to a low pressure separator. The low pressure separator 590 is configured to separate gases from the lube oil in a low pressure environment. The low pressure separator 590 can operate at a temperature of between about 120° C. and about 150° C. and at a pressure of between 0.3 MPa and about 0.5 MPa.

The separator 590 is designed to expel useless gases from the lube oil and includes a first discharge conduit 592 through which the gasses, such as hydrogen sulfide, water, ammonia and other useless gases, are expelled from the base oil. These gases can be delivered to another location where a device such as an incinerator is located for disposal of the gases since the gases are an unattractive by-product of the process and therefore are not recycled. The lube oil itself is discharged from the separator 590 through a second discharge conduit 594 and is introduced to further downstream processing where more constituents are expelled from the lube oil. Along the second discharge conduit 594 is a heater 610 that is configured to heat the lube oil to a predetermined temperature prior to the lube oil being further processed. In one embodiment, the lube oil is heated up to a temperature of between about 180° C. to about 220° C.

In the illustrated embodiment, the second discharge conduit 594 is connected to another separator 600, in the form of a gas stripping tower. In a gas stripping process, certain constituents can be removed from a stream (such as a hydrocarbon stream, in this case, a lube oil stream) by stripping the hydrocarbon stream with a gas stream. In particular, the heated feed stream (in this case heated lube oil) is fed to the gas stripping tower 600. The preheated stream is introduced through conduit 594 at or near the top of the gas stripping tower 600. Stripping gas is introduced through conduit 602 at or near the bottom of the tower 600. The stripping gas can be nitrogen or hydrogen or another suitable gas and is fed at a relatively high rate sufficient to provide a partial pressure that produces a stripped hydrocarbon (lube oil) stream that is removed through conduit 604 at or near the bottom of the tower 600 after flowing downward through the tower internals. The stripping gas bubbles up through the liquid hydrocarbon in the tower 600 becoming enriched in the constituents (e.g., hydrogen sulfide, moisture (water), ammonia and other useless gases) that are to be removed from the tower 600 and exits the top of the tower as a rich gas stream. The enriched gas stream can exit through a conduit 606 at or near the top of the tower 600. The conduit 606 is fluidly connected to the conduit 592 and the enriched gas stream can be delivered to another location, such as an incinerator.

The gas stripping tower 600 can be operated at a temperature of between about 180° C. and about 220° C. and at atmospheric pressure.

The stripped hydrocarbon (lube oil) stream travels through the conduit 604. A cooling device, such as a cooler, 611 is located along the conduit 604 and is designed to cool down the temperature of the base oil before transfer to another location, such as a blending room, where further processing of the lube oil can be performed.

The cooled hydrogen after passing through cooler 580 is fed to a storage vessel 620, in this case a hydrogen storage vessel, which stores the hydrogen that was recovered from the high pressure separator 570. In addition to hydrogen being fed to the vessel 620, a small amount of lube oil may also be delivered to and stored in the vessel 620. A compressor 630 is operatively connected to both the hydrogen vessel 620 and the mixer 510 to improve the pressure of the recycled hydrogen. For example, the compressor can operate between 4.2 MPa and 4.4 MPa.

Hydro-fining technology offers several advantages, such as the increase of conversion and yields of base oil, the stabilization of the unstaturated compound and diminishing the sulfur content. With the present invention, three different specifications of reactors 530, 540, 550 can be provided and the operator is therefore permitted to choose the optimal combination of reactors according to the raw materials (feed stream that is introduced into the plant 100). More specifically, the reactors can be in the form of hydrogenation reactors that contain selected hydrogenation catalysts which interact with the base oil and causes the base oil to undergo advanced chemical treatment to achieve a better product quality.

It will be appreciated that while FIG. 1 shows three hydrogenation reactors 530, 540, 550 as part of the plant 100, only one reactor (e.g., reactor 530) can be used or two or three reactors can be used to perform the hydrogenation treatment. For example, different combination of reactors can be used, such as reactors 1 and 2 or 1 and 3 or 2 and 3, etc. As is known, hydrogenation is a reductive chemical reaction which results in an addition of hydrogen ($H_2$), usually in order to saturate organic compounds. The process constitutes the addition of hydrogen atoms to the double bonds of a molecule through the use of a catalyst. A classical example of hydrogenation is the addition of hydrogen on unsaturated bonds between carbon atoms (converting alkenes to alkanes). Hydrogenation thus has three components, namely, the unsaturated substrate, the hydrogen (hydrogen source) and a catalyst.

Each reactor can therefore be filled with a particular catalyst or combination of catalysts that speed up the rate of reaction but also result in improved performance and an increase in the quality of the products formed. In one embodiment, catalysts that are used in the present invention include but are not limited to the following hydrogenation catalysts: (1) RL-1; (2) RJW-2; and (3) RN-32V. RL-1 is a lube oil hydrogenation catalyst that can improve the performance of the lube and offers high arene saturation, and good desulfuration as wells as denitrification activity. This catalyst also offers good isomerization capacity and activity in HP and MP conditions. The RL-1 catalyst has comparatively high performance in desulfurization and decolorization abilities. It improves the color and smell of oil and also enhances the viscosity properties at different application temperature. RJW-2 is a micro-crystalline wax hydro-fining catalyst that has high hydrogenation and arene saturation, weak cracking capacity, low resistance and good shape and strength. The RJW-2 catalyst is a dedicated "pore volume" design and therefore, restrains carbon deposit. Its high performance on protecting oil from being cracked also functions to wipe off hetero-atoms from molecules. RN-32V is a catalyst that is formulated to remove nitrogen atoms. This catalyst has the outstanding ability to improve oxidation stability, evaporation loss, color and enhance the strength of pour nature.

As previously mentioned, hydro-fining involves converting compounds to their saturated carbons by reacting with hydrogen. For example, different kinds of oxidative compounds, e.g., carboxylic acids, carboxylic acid esters, aldehydes, ketones, alcohols, peroxides, phenols, and other phenolic additives added in lubricating oils. These oxidative compounds are some of easier compounds to be converted into their corresponding saturated hydrocarbons and water by hydro-fining. At the same time, different kinds of reactions such as dealkylation, isomerization, condensation and ring-opening reactions are also occurring.

With respect to sulphur-based compounds that are found in the used lube oil, the most common are thiophenes and hydro-thiophenes. Spent oil also contains small amounts of sulpides, disulphides and other sulphur-based compounds including additives such as thiophosphates and sulphurized olefins and sulphuric phosphoric olefins. When compared to oxidative compounds, sulphur-based compounds are more difficult to treat by a hydro-fining process. Sulphides and disulphides are readily converted into their corresponding saturated carbons and hydrogen sulphide. Conversions of hydro-thiophenes are more difficult where ring-opening reactions should first take place.

Suitable RL-1, RJW-2 and RN-32V catalysts are commercially available from Petrochemical Science Research Institute of China and ChangLing Catalyst Manufacture of ChangLing city, China.

The used lubricating oil also includes nitrogen-based compounds. Typically, only small amounts of nitrogen-based compounds are present in used oil. These compounds including amines, pyridines, and pyrroles are mainly from base oil and additives. Denitrogenation is more difficult than desulphurization. The conversion will form corresponding saturated hydrocarbons and ammonia. In addition, the spent lubricating oil includes halogen-based compounds and hydrocarbons that are converted into their corresponding saturated hydrocarbons.

It will also be understood that the plant 100 includes a number of different computer operating systems that instruct and manage the re-refining process as it is performed at the multiple stations illustrated in FIG. 1. In one embodiment, the plant 100 includes a controller that allows a user to input certain information, such as operating parameters and the type or characteristics of feedstock (lube oil) being used. For example, a HollySys program for system control and surveillance can be used and includes a human interface that allows a programmer to input predetermined information. The control system preferably includes a processor that runs on operating software and includes memory. The control system can have a graphical control interface that permits for multi-tasking. In addition, the control system and control interface includes a display that displays the operation and status of the equipment. The operator can view data and graphics on the display that shows the process in real-time and also can show an alarm status on-line. In other words, the display can include a map or layout of the various stations and components of the plant 100 and the graphical user interface permits the user to gather additional information about any one of the various stations of the plant 100. In addition, when an error or malfunction occurs at a station, the graphical interface map can highlight the particular station that is operating not at all or outside of acceptable operating specifications. For example, the particular station operating outside of specifications can be highlighted in red to indicate an error and that investigation is needed at this station, while the other stations that are operating properly can be indicated in a neutral color or no color at all or can even be indicated with a green tag or indicator to indicate proper operation.

The process re-refining process described above advantageously removes the following contaminants: (1) mechanical impurities caused by metal wear, air pollutants and additives; (2) water from air and combustion; (3) light oil which can be used for equipment cleaning material (gasoline, kerosene, diesel and light organic solvent); (4) resin and asphalt contaminants that form when the lube oil is used in high temperature; (5) oxidized compounds and oil deteriorated due to the chemical changes in high temperature process; (6) deteriorated additives due to decomposition and oxidation condensation of the additive; (7) residue compounds that form when the oil is used at high temperatures; (8) sulfur compounds from additive and fuel oil; (9) oxygen compounds, especially phenol compounds caused by heat; (10) nitrogen compounds, especially hetero-atom compounds; (11) chlorine compounds that result from rubber parts; and (12) other contaminants typically found in the used lube oil.

The plant 100 and re-refining process of the present invention provides excellent reclamation results. In part this is based on the combination of a propane extraction process and a hydro-fining process that ensure a recovery yield of over about 90% and in particular, about 97% or more. The propane extraction process purifies the waste oil against asphalt, resin, additive, and metal compounds and permits a distillation process with much ease and prevents harmful material to contact with catalyst. In addition, the hydro-fining process described above utilizes hydrogen treatment to improve the color quality and eliminate the unpleasant smell from base oil.

Applicant has also discovered a number of advantages that are obtained using the described re-refining process and arrangement of equipment as illustrated in plant 100. For example, the strainer 114 provides multi-filtration to remove mechanical impurities and the cyclone separator 130 removes a large amount of water from the used lube oil. Mixer 211 is a powerful device that ensures the intensive mixing of propane with waste oil. The multi-stage sedimentation process stage with towers having inverted cone shaped outlines ensures the complete removal of resin and asphalt. In addition, the static mixer for the hydrogen and lube oil ensure the intensive mixing of hydrogen with the lube oil.

The following results are also obtained when using the re-refining process described hereinbefore: (1) copper corrosion levels can reach the level 1a-1b after removal of the sulfur compounds and oxidation; (2) anti-rust can reach a low level; (3) the re-refined lube oil has a color number about between about 0.5 to about 1.0 based on a standard color code; (4) irritating smell is eliminated; (5) oxidation stability is more than 120 minutes; (6) the pour point is less than −15° C.; (7) the flash point is higher than 200° C.; (8) evaporation loss is less than 15%; (9) and the acid value is less than 0.05 mgKOH/g.

The plant 100 also is a fully airtight system that can operate 24 hours continuously and requires no mixture of any chemical substance. In addition, there is no second pollution with the plant 100 and it is adapted to receive waste oil from different sources. In addition, the reclaimed products and the re-refined lube oil is of good quality and the re-refining process of the present invention offers a high recovery rate.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A method of re-refining used oil comprising the steps of: processing the used oil to remove select constituents of the used oil; introducing liquefied propane into the used oil to form an oil/propane mixture; processing the oil/propane mixture in an extraction process that includes a plurality of extraction towers linked in series, wherein each extraction tower has an inverted cone shape to promote enhanced removal and recovery of undesired components that settle in the tower and are discharged to a storage container; and transferring the oil/propane mixture from the last extraction tower in the series to at least one propane recovery tower where propane is withdrawn from the mixture and the used oil is ready for further processing, wherein the method further includes the steps of distilling the oil in a distillation apparatus after the propane extraction process; withdrawing at least a portion of at least one distillate fraction from the distillation apparatus; delivering at least a portion of the at least one withdrawn distillate fraction to at least one other distillation apparatus arranged in series for withdrawing at least a portion of at least one distillate fraction from the at least other distillation apparatus; and delivering at least a portion of the at least one withdrawn distillate fraction to a hydro-fining process, wherein the oil is heated prior to introduction to the distillation apparatus and the at least one withdrawn distillate fraction is heated after withdrawal from the distillation apparatus and prior to introduction to the at least one other distillation apparatus.

2. The method of claim 1, wherein the plurality of extraction towers comprises at least two extraction towers linked in series.

3. A method of re-refining used oil comprising the steps of: filtering the used oil through a multi-layer filter; processing the used oil in a cyclone separator for removing water from the used oil after the used oil has been filtered; distilling a feedstock from the cyclone separator for eliminating a trace amount of water and light hydrocarbon fraction from the used oil; introducing liquefied propane into the used oil to form an oil/propane mixture; processing the oil/propane mixture in an extraction process that includes a plurality of extraction towers linked in series, wherein each extraction tower has an inverted cone shape to promote enhanced removal and recovery of undesired components that settle in the tower and are discharged to a storage container; and transferring the oil/propane mixture from the last extraction tower in the series to at least one propane recovery tower where propane is withdrawn from the mixture and the used oil is ready for further processing, wherein the extraction tower is used to remove the propane which goes to an incinerator from the lube oil at a temperature between about 120° C. to about 150° C. and at a pressure of about 0.05MPa.

4. The method of claim 1, further including the steps of: storing the used oil in at least one settler after it has been processed in the cyclone separator; and introducing the used oil into a flash tower after the used oil has been heated up to at least 200° C. after being discharged from the at least one settler, the flash tower operating under an absolute vacuum, wherein water and a light oil fraction are removed from the used oil, the used oil being introduced to the flash tower prior to introducing the liquid propane into the used oil, wherein the water and light oil fraction that are removed from the used oil are collected using a condenser.

5. The method of claim 1, wherein the hydro-fining process includes the steps of: mixing hydrogen with the oil after the oil is discharged from the last distillation apparatus in the series; introducing the hydrogen and oil mixture into at least one hydro-fining reactor that is packed and allows hydrogenation of select compounds in the oil to occur; and introducing the hydro-treated oil into a high pressure separator that is configured to separate hydrogen from the hydro-treated oil in a high pressure environment; and introducing the oil that has been discharged from the high pressure separator into a low pressure separator that is configured to separate one or more gases from the oil in low pressure environment.

6. The method of claim 5, wherein the high pressure separator operates at a temperature of between about 120° C. to about 150° C. and at a pressure of between about 4.0 MPa and about 4.2 MPa.

7. The method of claim 5, wherein the low pressure separator operates at a temperature of between about 120° C. to about 150° C. and at a pressure of between about 0.3 MPa and about 0.5 MPa.

8. The method of claim 5, wherein the at least one hydro-fining reactor comprises a plurality of packed hydro-fining reactors that are arranged in series.

9. A method of re-refining used oil comprising the steps of: filtering the used oil through a multi-layer filter; processing the used oil in a cyclone separator for removing water from the used oil after the used oil has been filtered; distilling a feedstock from the cyclone separator for eliminating a trace amount of water and light hydrocarbon fraction from the used oil; introducing liquefied propane into the used oil to form an oil/propane mixture; processing the oil/propane mixture in an extraction process that includes a plurality of extraction towers linked in series, wherein each extraction tower has an inverted cone shape to promote enhanced removal and recovery of undesired components that settle in the tower and are discharged to a storage container; and transferring the oil/propane mixture from the last extraction tower in the series to at least one propane recovery tower where propane is withdrawn from the mixture and the used oil is ready for further processing and wherein the method further comprises the steps of distilling the oil in a distillation apparatus after the propane extraction process; withdrawing at least a portion of at least one distillate fraction from the distillation apparatus; delivering at least a portion of the at least one withdrawn distillate fraction to at least one other distillation apparatus arranged in series for withdrawing at least a portion of at least one distillate fraction from the at least other distillation apparatus; and delivering at least a portion of the at least one withdrawn distillate fraction to a hydro-fining process, wherein the hydro-fining process includes the steps of: mixing hydrogen with the oil after the oil is discharged from the last distillation apparatus in the series; introducing the hydrogen and oil mixture into at least one hydro-fining reactor that is packed and allows hydrogenation of select compounds in the oil to occur; and introducing the hydro-treated oil into a high pressure separator that is configured to separate hydrogen from the hydro-treated oil in a high pressure environment; and introducing the oil that has been discharged from the high pressure separator into a low pressure separator that is configured to separate one or more gases from the oil in low pressure environment, wherein the plurality of reactors comprise hydro-refining reactors that are linked in series and have different specifications from one another.

10. The method of claim 9, wherein the different specifications comprise different catalyst makeup, at least one reactor having a different catalyst makeup than the other reactor.

11. The method of claim 5, wherein the step of mixing hydrogen with the oil includes using a static mixer to mix the hydrogen with the oil.

12. The method of claim 5, further including the step of delivering the used oil from the low pressure separator to a gas stripping tower that includes a feed of nitrogen gas to produce a stripped hydrocarbon stream.

13. A method of re-refining used oil comprising the steps of: filtering the used oil through a multi-layer filter; processing the used oil in a cyclone separator for removing water from the used oil after the used oil has been filtered; distilling a feedstock from the cyclone separator for eliminating a trace amount of water and light hydrocarbon fraction from the used oil; introducing liquefied propane into the used oil to form an oil/propane mixture; processing the oil/propane mixture in an extraction process; transferring the oil/propane mixture from the last extraction tower in the series to at least one propane recovery tower where propane is withdrawn from the mixture and the used oil is ready for further processing; distilling the oil in a distillation apparatus after the propane extraction process; withdrawing at least a portion of at least one distillate fraction from the distillation apparatus; delivering at least a portion of the at least one withdrawn distillate fraction to at least one other distillation apparatus arranged in series for withdrawing at least a portion of at least one distillate fraction from the at least other distillation apparatus; and delivering at least a portion of the at least one withdrawn distillate fraction to a hydro-fining process that includes a plurality of packed hydro-fining reactors that are arranged in series, wherein the reactors include different catalyst makeup and are operatively connected to other components to allow a user to select the quantity and number of hydro-fining reactors that are placed on-line in the hydro-fining process, thereby allowing the user to customize the catalysts being used depending upon specification of the used oil.

14. The method of claim 13, further including the steps of: introducing the hydro-treated oil into a high pressure separator that is configured to separate hydrogen from the hydro-treated oil in a high pressure environment; and introducing the oil that has been discharged from the high pressure separator into a low pressure separator that is configured to separate one or more gases from the oil in low pressure environment.

15. The method of claim 13, further including the step of: delivering the used oil from the low pressure separator to a gas stripping tower that includes a feed of nitrogen gas to produce a stripped hydrocarbon stream.

16. The method of claim 4, further including the step of: cooling the oil subsequent to the oil being discharged from the flash tower.

17. A method of re-refining used oil comprising the steps of:

processing used oil to remove select constituents from the used oil; introducing liquefied propane into the used oil to form an oil/propane mixture; processing the oil/propane mixture in an extraction process that includes a plurality of extraction towers linked in series, wherein each extraction tower has an inverted cone shape to promote enhanced removal and recovery of undesired components that settle in the tower and are discharged to a storage container; and transferring the oil/propane mixture from the last extraction tower in the series to at least one propane recovery tower where propane is withdrawn from the mixture and the used oil is ready for further processing and wherein the method further comprises the steps of distilling the oil in a distillation apparatus after the propane extraction process; withdrawing at least a portion of at least one distillate fraction from the distillation apparatus; delivering at least a portion of the at least one withdrawn distillate fraction to at least one other distillation apparatus arranged in series for withdrawing at least a portion of at least one distillate fraction from the at least other distillation apparatus; and delivering at least a portion of the at least one withdrawn distillate fraction to a hydro-fining process, wherein the hydro-fining process includes the steps of: mixing hydrogen with the oil after the oil is discharged from the last distillation apparatus in the series; introducing the hydrogen and oil mixture into at least one hydro-fining reactor that is packed and allows hydrogenation of select compounds in the oil to occur; and introducing the hydro-treated oil into a high pressure separator that is configured to separate hydrogen from the hydro-treated oil in a high pressure environment; and introducing the oil that has been discharged from the high pressure separator into a low pressure separator that is configured to separate one or more gases from the oil in low pressure environment, wherein the plurality of reactors comprise hydro-refining reactors that are linked in series and have different specifications from one another.

* * * * *